US009192993B1

(12) United States Patent
Seals et al.

(10) Patent No.: US 9,192,993 B1
(45) Date of Patent: Nov. 24, 2015

(54) PROCESSES FOR FABRICATING COMPOSITE REINFORCED MATERIAL

(75) Inventors: Roland D. Seals, Oak Ridge, TN (US); Edward B. Ripley, Knoxville, TN (US); Gerard M. Ludtka, Oak Ridge, TN (US)

(73) Assignees: Consolidated Nuclear Security, LLC, Reston, VA (US); UT-Battelle, LLC, Oak Ridge, TN (US)

( * ) Notice: Subject to any disclaimer, the term of this patent is extended or adjusted under 35 U.S.C. 154(b) by 2 days.

(21) Appl. No.: 13/530,183

(22) Filed: Jun. 22, 2012

Related U.S. Application Data

(62) Division of application No. 11/136,878, filed on May 25, 2005, now Pat. No. 8,231,703.

(51) Int. Cl.
*B22F 7/04* (2006.01)
*B22F 7/08* (2006.01)
*C22C 26/00* (2006.01)

(52) U.S. Cl.
CPC ... *B22F 7/04* (2013.01); *B22F 7/08* (2013.01); *C22C 26/00* (2013.01); *B22F 2007/047* (2013.01); *C22C 2026/002* (2013.01)

(58) Field of Classification Search
USPC ..... 419/8, 9
See application file for complete search history.

(56) References Cited

U.S. PATENT DOCUMENTS 4,683,118 A * 7/1987 Hayashi et al. ..... 419/23
5,401,292 A 3/1995 Japka
5,578,543 A 11/1996 Tennent et al.
6,228,904 B1 5/2001 Yadav et al.
6,420,293 B1 * 7/2002 Chang et al. ..... 501/95.2
7,217,311 B2 * 5/2007 Hong et al. ..... 75/345
2003/0010409 A1 * 1/2003 Kunze et al. ..... 148/513
2003/0099592 A1 5/2003 Rodriguez et al.
2004/0131835 A1 7/2004 Schmitt et al.
2004/0265209 A1 * 12/2004 Colbert et al. ..... 423/447.1
2005/0133121 A1 6/2005 Subramanian et al.
2005/0186104 A1 * 8/2005 Kear et al. ..... 419/11
2006/0000310 A1 1/2006 Solimnjad
2006/0263584 A1 11/2006 Schulz-Harder et al.
2008/0038140 A1 2/2008 Barrera et al.

* cited by examiner

*Primary Examiner* — George Wyszomierski
*Assistant Examiner* — Ngoclan T Mai
(74) *Attorney, Agent, or Firm* — Michael J. Renner, Esq.; Luedeka Neely Group, P.C.

(57) ABSTRACT

A family of materials wherein nanostructures and/or nanotubes are incorporated into a multi-component material arrangement, such as a metallic or ceramic alloy or composite/aggregate, producing a new material or metallic/ceramic alloy. The new material has significantly increased strength, up to several thousands of times normal and perhaps substantially more, as well as significantly decreased weight. The new materials may be manufactured into a component where the nanostructure or nanostructure reinforcement is incorporated into the bulk and/or matrix material, or as a coating where the nanostructure or nanostructure reinforcement is incorporated into the coating or surface of a "normal" substrate material. The nanostructures are incorporated into the material structure either randomly or aligned, within grains, or along or across grain boundaries.

6 Claims, 6 Drawing Sheets

PROCESSES FOR FABRICATING COMPOSITE REINFORCED MATERIAL

CROSS REFERENCES TO RELATED APPLICATIONS

This application is a Divisional of U.S. Pat. No. 8,231,703 filed May 25, 2005 entitled "Nanostructured Composite Reinforced Material." This application claims a priority date of May 25, 2005 which is the filing date of U.S. Pat. No. 8,231,703. U.S. Pat. No. 8,231,703 is incorporated by reference in its entirety herein.

GOVERNMENT RIGHTS

The U.S. Government has rights to this invention pursuant to contract number DE-AC05-00OR22800 between the U.S. Department of Energy and Babcock & Wilcox Technical Services Y-12, LLC.

BACKGROUND OF THE INVENTION

1. Field of the Invention

The invention is generally related to reinforced materials and more particularly to materials that are reinforced through the use of nanostructures to be super strong materials.

2. General Background

In the present state of the art, reinforced composites use particles or fibers which have micron-sized diameters. Fiberglass and carbon fiber composites are examples of fiber-reinforced composites. Typical fibers used in state-of-the-art composites have diameters greater than 0.0001-inches (2.54 microns) to 0.005-inches (30.4 microns), and length/diameter (L/D) ratios greater than 1 micron. Carbon fiber reinforcements are typically 5 to 8 microns diameter and grouped into tows or yarns of 2,000 to 12,000 fibers. The fiber modulus can range from 207 GPa to 960 GPa.

A typical fiber-reinforced material combines the properties of the fiber material with those of the matrix material in which the fibers are embedded. A variety of combinations of fiber and matrix materials are used; e.g., glass, carbon, and ceramic fibers are used with epoxy resin, glass, metal, ceramic, and carbon matrix materials. A composite material is one in which two or more materials that are different are combined to form a single structure with an identifiable interface. Typically, a composite material is formed from a matrix material (such as metals, ceramics, or polymers) with reinforcing materials as particles or fibers (such as ceramics or carbon and fillers). The new structure of the composite material has properties that are dependent upon the properties of the constituent materials as well as the properties of the interface. A composite material offers properties that are more desirable than the properties of the individual materials. Whereas the two or more contributing materials in a composite material retain their own distinctive properties, the new composite material has properties which cannot be achieved by the individual components alone. More narrowly, a composite material is composed of single or hybrid reinforcement materials embedded in a matrix material.

Composite materials typically form molecular bonds in which the original materials retain their identity and mechanical properties. They can have very selective directional properties. In comparison, metal alloys form bonds at the atomic level to produce homogenous materials that have isotropic properties (the same in all directions).

An example of a polymer composite or fiber reinforced polymer (FRP) composite is a thermoset or thermoplastic polymer matrix reinforced with fibers. The FRP composites are composed of resins such as polyesters, vinyl esters, and phenolics with reinforcements such as glass fibers.

A metal matrix composite (MMC) combines into a single material a metallic base with a reinforcing constituent, which is usually a non-metallic such as a ceramic or carbon fiber. Combining two pre-existing constituents with commonly used processes such as powder metallurgy, diffusion bonding, liquid phase sintering, squeeze-infiltration, or stir-casting generally produces composites. Highly reactive metals are typically formed by in situ chemical reactions within a precursor of the composite. MMCs have several distinct classes, generally defined with reference to the shape and size of the reinforcement constituent, such as Particle-Reinforced Metal Matrix Composites, Short-Fiber and Whisker-Reinforced Metal Matrix Composites, Continuous Fiber-Reinforced Metal Matrix Composites, Monofilament-Reinforced Metal Matrix Composites, Interpenetrating Phase Composites, and Liquid Phase Sintered Metallic Composites. Particle-Reinforced Metal (PRMS) Matrix Composites contain approximately equiaxed reinforcements, with an aspect ratio of less than about 5. The reinforcements are typically ceramic such as SiC or $Al_20_3$. These are produced by solid state (e.g., powder metallurgy) or liquid metal techniques (e.g., stir-casting, infiltration). Short-Fiber and Whisker-Reinforced Metal (SFMs and WRMs) Matrix Composites contain reinforcements with an aspect ratio of greater than 5. The SFMs and WRMs are commonly produced by squeeze infiltration. Continuous Fiber-Reinforced Metal (CFRM) Matrix Composites contain continuous fibers, such as $Al_20_3$, SiC, and carbon, with a diameter of below about 20 microns, and are produced by squeeze infiltration with the fibers parallel or pre-woven. Monofilament-Reinforced Metal (MRM) Matrix Composites contain fibers that are relatively large in diameter (typically about 100 microns) and are produced by solid state processes requiring diffusion bonding. Examples include SiC monofilament-reinforced titanium. Interpenetrating Phase Composites have the metal reinforced with a three-dimensionally percolating phase, such as ceramic foam. Liquid Phase Sintered Metallic composites include cemented carbides, in which the carbide particles are bonded together by a metal such as cobalt.

Composites combine the strength of the reinforcement with the toughness of the matrix to achieve desirable properties. The advantages of composites are high strength, high stiffness, low weight ratio, and designed specifics. The composite materials can be separated into three categories based on the strengthening mechanism: i.e., dispersion strengthened, particle reinforced, and fiber reinforced. Dispersion strengthened composites have a fine distribution of particles embedded in the matrix and impede the mechanisms that allow a material to deform (including dislocation movement and slip). Many metal-matrix composites fall into the dispersion strengthened composite category. Particle reinforced composites have a large volume fraction of particles dispersed in the matrix and the load is shared by the particles and the matrix. Most commercial ceramics and many filled polymers are particle reinforced composites. Fiber reinforced composites use the fiber as the primary load-bearing component.

Carbon nanotubes (CNTs) were discovered in 1991 by S. Iijima [S. Iijima, *Nature*, 354, 56 (1991)). These large macromolecules are long, thin cylinders of carbon that have unique size, shape, and remarkable physical properties. They can be thought of as a sheet of graphite (a hexagonal lattice of carbon) rolled into a cylinder. They are light, flexible, thermally stabile, and are chemically inert. They have the ability to be either metallic or semi-conducting depending on the "twist" of the tube. Having phenomenal electronic and structural properties, CNTs have been endorsed as the strongest material known to man with an axial Young's modulus >1 TPa, a predicted bundled strength of 130 GPa, and the highest strength-to-weight ratio known being 100 times stronger than steel but only one-sixth the weight.

The earliest nanotubes were made from pure carbon. Formed naturally in the sooty residue of vaporized carbon rods, they were an elongated form of fullerene or "buckyball" molecules, clusters of 60 and 70 carbon atoms joined in a graphite-like mesh of hexagonal rings. The first generations were "multi-walled nanotubes" (MwNTs) that consisted of about 5 to 40 single-walled nanotubes (SWNTs) wherein each tube nested inside the other like Russian dolls. A SWNT means the wall of the tube consists of only a single layer of carbon atoms. Later, when scientists began to directly make SWNTs, it was discovered that they could be drawn out to exceedingly long lengths of nanowire without losing any strength or durability.

Bundled SWNT are predicted to have the largest strength-to-weight ratio of any known material, and promise new generations of lightweight, supertough structural materials which could replace metals in the bodies and engines of automobiles, aircraft, and ships, as well as form a new class of energy-efficient building materials. Single-walled carbon nanotubes are also highly thermally conductive, can withstand high temperatures, and are resistant to even strong acids. Finally, SWNT recently exhibited 8 wt. % hydrogen sorption (the highest for any carbon material) which make them desirable for hydrogen storage fuel cells for clean cars of the future.

Carbon nanotubes are almost always coated or partially coated with a thin layer of material, typically carbon, that is just discernible in Transmission Electron Microscope (TEM) images. The surface of a clean nanotube is "slippery", that is, unlikely to provide an anchor for mechanical reinforcement or is unlikely to be wetted by the matrix material. Because carbon nanotubes are still a new and emerging technology, there is little or no work in the field of using them to produce reinforced materials.

SUMMARY OF THE INVENTION

The invention addresses the needs in the known art. What is provided is a family of materials wherein nanostructures and/or nanotubes are incorporated into a multi-component material arrangement, such as a metallic or ceramic alloy or composite/aggregate, producing a new super strong material or metallic/ceramic alloy. This new family of super strong materials provides significant performance enhancements due to superior material properties. Such superior properties include increased strengths up to and perhaps exceeding several thousand times normal, the upper bound of which has not yet been determined; improved elasticity, wear, electrical, corrosion, fatigue, and thermal characteristics; and improved strength-to-weight ratios. Such improved properties can revolutionize applications and provide materials for super strong structures such as: stronger steel beams for construction; power transmission cables that have high stiffness, high electrical conductance, and very low electrical loss; crash protection barriers; "light weight" materials for automotive and transportation components; and high performance coatings or surfaces.

The new materials may be manufactured into a component where the nanostructure or nanostructure reinforcement is incorporated into the bulk and/or matrix material, or as a coating where the nanostructure or nanostructure reinforcement is incorporated into the coating or surface of a "normal" substrate material. The metal alloys include, but are not limited to, iron-based materials, first-row metal alloys, second-row metal alloys, third-row metal alloys, and refractory metal alloys. The nanostructures include, but are not limited to, carbon, boron, and silicon-based materials. The nanostructures may be particles, nanotubes, single-walled nanotubes, multi-walled nanotubes, bundles of nanotubes, nanoropes, nanofibers, nanohorns, and any combination of these. The nanostructures are incorporated into the material structure either randomly or aligned, within grains, or along or across grain boundaries. This incorporation can be accomplished either statically or dynamically in the liquid phase state, two-phase liquid plus solid regime, solid state condition, or any combination of these with or without the application of external effects.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

The invention is generally comprised of a material that has nanostructures and/or nanotubes incorporated into a multi-component material arrangement, such as a metallic or ceramic alloy or composite/aggregate.

The reinforced material may be manufactured as a component wherein the nanostructure or nanostructure reinforcement is incorporated into the bulk and/or matrix of the original material, or as a coating wherein the nanostructure or nanostructure reinforcement is incorporated into a coating or surface of the "normal" substrate material.

The metal alloys include, but are not limited to, iron-based materials, first-row metal alloys, second-row metal alloys, third-row metal alloys, and refractory metal alloys. The nanostructures and/or nanotubes include, but are not limited to, carbon, boron, and silicon-based materials. The nanostructures may be particles, nanotubes, single-walled nanotubes, multi-walled nanotubes, bundles of nanotubes, nanoropes, nanofibers, nanohorns, or any combination of these. Metallic/ceramic (metal alloys, ceramics cermets, or intermetallics) alloy particles, or material particles, are mixed with nanostructures that have a small amount of typically surface residual glass carbon in an inert environment. The metallic/ceramic (metal alloys, ceramics, cermets, or intermetallics) alloy particles may also be mixed with a carbon nanostructures-carbon particles mixture. The residual carbon or carbon particles may be glassy carbon, graphite, or another form of carbon. The mixture is heated in an inert atmosphere to the point of sinter or to cause reaction with the glass carbon. Sintering is the process of forming a coherent bonded mass by heating metal powders without melting. For metallic/ceramic alloy reinforced material, the mixture is heated to the point of chemical interaction, or to the eutectic point. Sintering may occur at a temperature below the eutectic point.

The nanostructures are incorporated into the material structure either randomly or aligned (via thermomechanical and/or magnetic/electric field processing), within grains (intragranular), or along (intergranular), or across (transgranular) grain boundaries.

Figure 1:
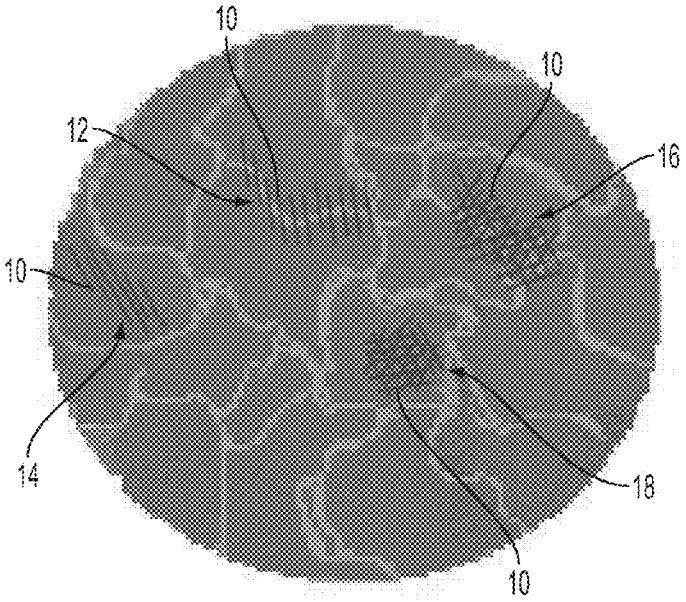
FIG. 1 illustrates grains of a reinforced material with examples of the nanostructures in different arrangements.

FIG. 1 illustrates examples of nanostructures 10 in an aligned arrangement 12 across grain boundaries (transgranular), an aligned arrangement 14 within a grain (intragranular), a three dimensional arrangement 16 across grain boundaries, and a three dimensional arrangement 18 within grain boundaries.

Figure 2:
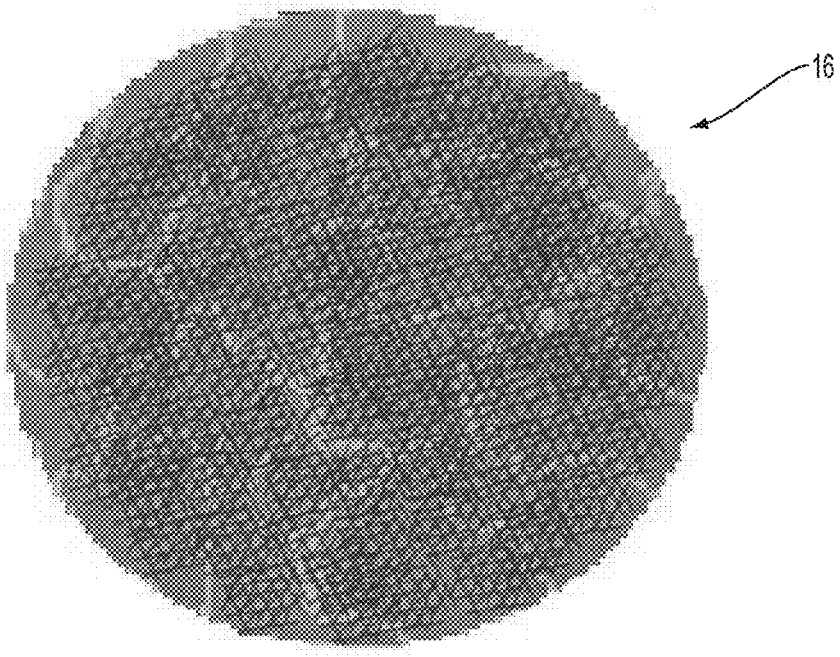
FIG. 2 illustrates grains of a reinforced material with a three dimensional arrangement of the nanostructures throughout the microstructure.
Figure 4:
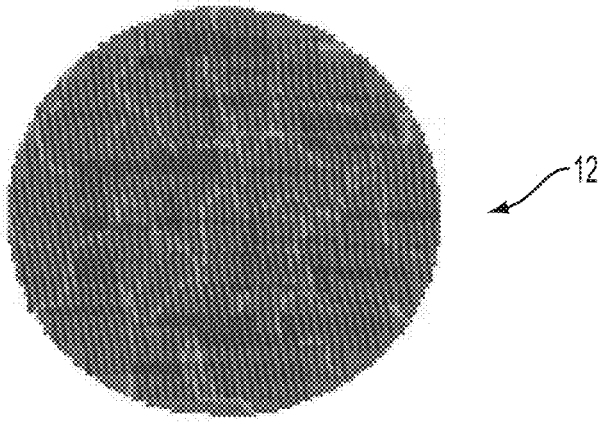
FIG. 4 illustrates grains of a reinforced material with the nanostructures aligned throughout the microstructure.

FIG. 2 illustrates the three dimensional arrangement 16 across grain boundaries. FIG. 4 illustrates the aligned arrangement 12 across grain boundaries.

Figure 5:
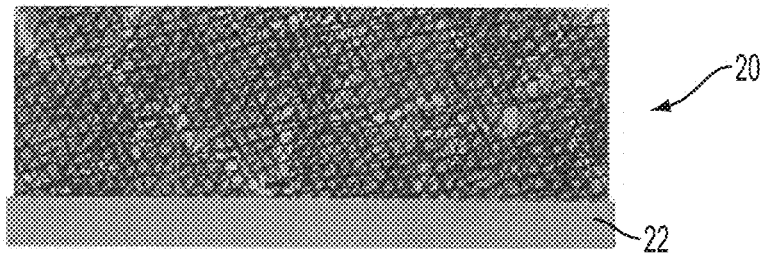
FIG. 5 illustrates grains of a reinforced material with a three dimensional arrangement of the nanostructures in a portion of the microstructure as a coating.

FIG. 5 illustrates the three dimensional transgranular arrangement wherein the nanostructures and base material are combined to provide a coating 20 on the base material 22.

Figure 6:
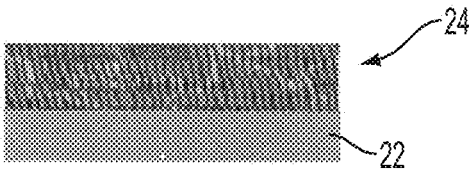
FIG. 6 illustrates grains of a reinforced material with aligned nanostructures in a portion of the microstructure as a multi-layer coating.

FIG. 6 illustrates the aligned transgranular arrangement wherein the nanostructures and base material are combined to provide a multi-layer coating 24 on the base material 22. The multi-layer coating 24 is discussed below.

The reinforced materials of the invention can be produced as described below. Powdered metallic/ceramic, metal alloy, or ceramic particles, or material particles, are mixed with powdered nanostructures that have a small amount of typically surface residual glassy or amorphous carbon in an inert environment. The metallic/ceramic alloy particles may also be mixed with a carbon nanostructures-carbon particles mixture. The residual carbon or carbon particles may be glassy carbon, graphite, or another form of carbon. The mixture is then formed into a powder compact, preferably by pressing. The compact is heated in an inert atmosphere to the point of sinter or to cause reaction with the glassy carbon or amorphous surface carbon. Sintering is the process of forming a coherent bonded mass by heating metal powders without melting. For metallic alloy reinforced material, the compact is heated to the point of chemical interaction, or to the eutectic point. Sintering may occur at a temperature below the eutectic point. The starting powder for consolidation, sintering, or further processing may be made as next outlined. A metal alloy, ceramic, or cermet (metal alloy-ceramic) powder, blended or mixed with carbon nanostructure materials, with or without residual surface carbon, with or without metal catalyst (such as Fe, Co, Ni, CoNi, etc., at a concentration 1-3% atomic percent), and/or made into slurry, and ball-milled is dried or spray dried to form a composite powder mix for subsequent consolidation processing by hot pressing, sintering, etc. Other variations of this process such as, a metal alloy, ceramic, or cermet (metal alloy-ceramic) powder is ball-milled to a fine powder, blended or mixed with carbon nanotubes materials, with or without residual surface carbon, with or without metal catalyst (such as Fe, Co, Ni, CoNi, etc., at a concentration 1-3% atomic percent), and/or blended and/or made into slurry, dried or spray dried to form a composite powder mix for subsequent consolidation processing by hot pressing, sintering, etc.

Further, sintering may be liquid phase sintering. For powder mixtures, however, the sintering temperature may be above the melting point of the lower-melting constituent, e.g. copper/tin alloys, iron/copper structural parts, tungsten carbide/cobalt cemented carbides, W—Ni—Fe, W—Ni—Cu, Fe—Cu, and Mo—Cu (some with Cu—P additions) so that sintering in all these cases takes place in the presence of a liquid phase; hence, the term liquid phase sintering. It is, of course, essential to restrict the amount of liquid phase in order to avoid impairing the shape of the part. Liquid phase sintering is a net-shaping technology applicable to many high performance alloys. The wetting liquid provides a capillary force that pulls the solid particles together and induces particle rearrangement. In addition, the liquid gives rapid mass transport at the sintering temperature. The rapid mass transport results in solution-re-precipitation and improved grain packing by grain shape accommodation. Hence, the presence of a liquid phase during sintering promotes densification in the compacts.

At the eutectic point, the surface carbon on the nanostructures diffuses into the metallic alloy and a reinforced alloy (super alloy) is formed that has a carbon content with a melting temperature below the temperature of the eutectic point. At this point, localized melting and rapid liquid phase diffusion of the carbon will occur, the local chemistry will be subsequently lowered in carbon content, the local melting temperature of the local chemistry will shift back again to exceed the furnace temperature, solidification will occur and, thus, the interaction, sintering or reaction will arrest. The temperature may be then increased until near theoretical density is obtained and the part is then quenched or cooled.

The material formed is reinforced by the presence of "inert" nanostructures (within grains and/or along/across grain boundaries as described above) wherein the surface carbon has diffused into the matrix structure of the base material 22 and attached the nanostructures to the matrix of the base material. The reinforcement enhances the material strength, stiffness, toughness, corrosion resistance, etc.

Figure 3:
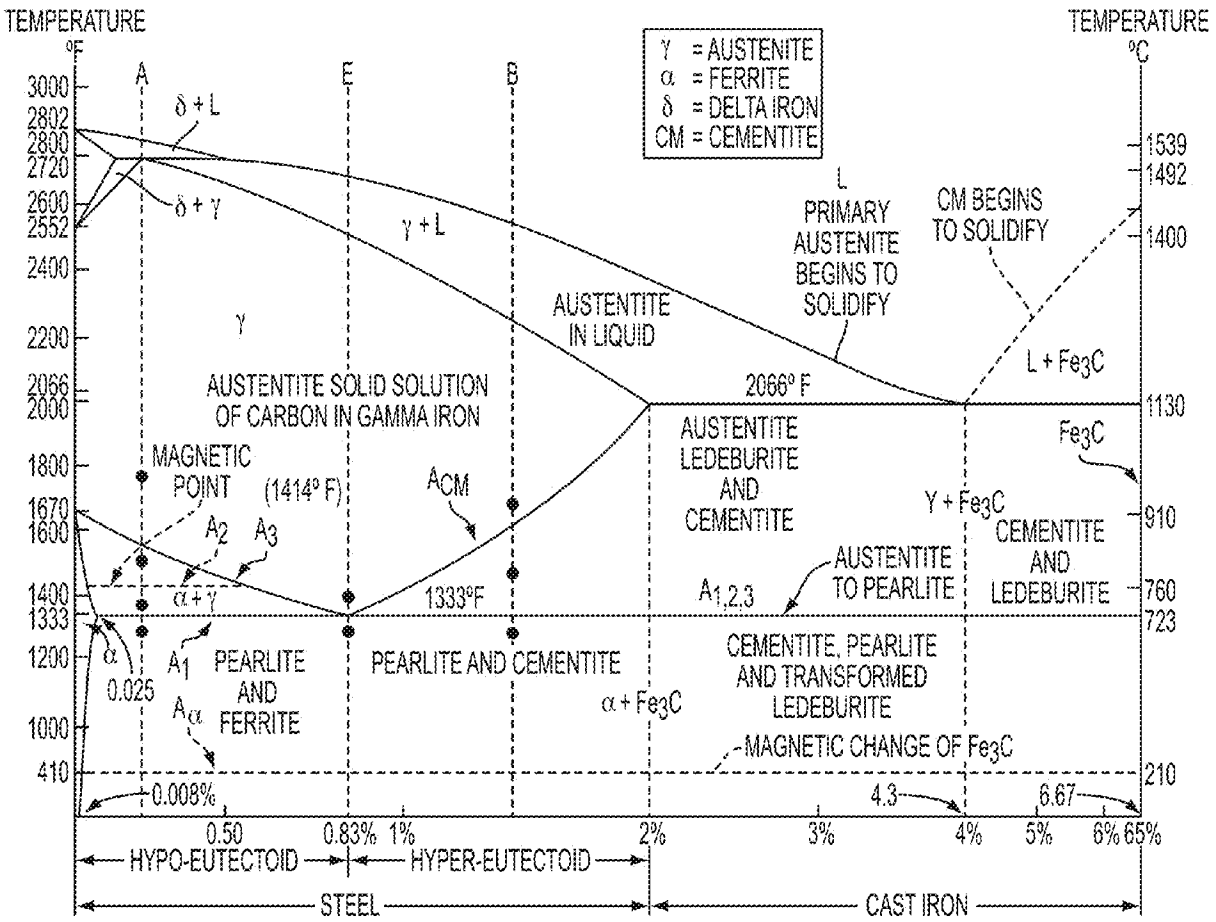
FIG. 3 is the iron-rich side of the iron-carbon equilibrium phase diagram.

As an example of the invention, reinforced steel can be produced as follows. Very fine iron (Fe) particles and nanostructures with a small amount of associated glassy carbon are combined in an inert atmosphere and pressed into a powder metal compact. The compact is heated in an inert atmosphere to the softening point of the metal catalyst or to sinter (at least four tenths the melting point of the compact mixture). A temperature as low as $T \geq 0.4\ T_{mp}$ where T and $T_{mp}$ are in degrees Kelvin, T is the processing temperature, and $T_{mp}$ is the melting point of the matrix (iron or steel in the present example), should be sufficient for the process to occur. The typical T range is from $T=0.4\ T_{mp}$, to $0.7\ T_{mp}$. The compact is heated in an inert atmosphere or a vacuum into the solid solution region, seen in the graph of FIG. 3, until the eutectic temperature point of the compact (horizontal temperature line marked 2066° F.) is reached and/or exceeded. The compact will start to sinter at this temperature.

Sufficient time at temperature is employed such that as the carbon surface of the bundles of nanostructures diffuses into the volume of the iron: (a) the carbon content of the iron will be increased locally around the nanostructure to form a steel alloy that has a locally higher melting temperature now at or below the furnace temperature (local carbon gradient chemistry will therefore momentarily exist in the austenite plus liquid regime); (b) local melting (eutectic brazing) will initiate; (c) rapid liquid phase diffusion of the carbon will occur, causing the local carbon content to lower again, which will raise the melting temperature of these chemistries above the furnace temperature; (d) local solidification around the nanostructure will occur due to the reduced carbon content and upward shift of local solidification temperatures; and (e) a high integrity interface between the nanostructure and ferrous alloy will result.

As required, fine amounts of alloy additions could initially be added to the base iron alloy or mixed with the nanostructures to facilitate excellent surface wetting between the matrix and nanostructure during the melting/solidification cycle to promote superior interfacial contact and maximized reinforcement performance. If required to eliminate porosity, the time at temperature may be continued or the temperature may be increased until near theoretical density is reached. The part is then cooled.

The low temperature material will comprise a metallic part with nanostructures throughout the microstructure as seen in FIGS. 1, 2, and 4. The pressure caused by the solidification will result in ultra hard precipitates in a high-pressure (prestressed) condition distributed throughout the metal matrix. This will result in improved fatigue behavior (inhibit crack initiation). The presence of the carbonaceous species throughout the final microstructure will improve wear resistance.

As seen in arrangements 12 and 14 in FIG. 1, alignment of the nanostructures and metal powder can be performed prior to and during the step of pressing into a solid compressed, green (not final) part or as part of a batch or continuous casting operation. Alignment can be accomplished by the use of a strong electrical or magnetic field prior to or during the pressing step, Use of a magnetic field during the pressing step helps to maintain nanostructure alignment for further improving the strength of the sintered or cast product in one axis. This allows tailoring of directional performance enhancement through microstructural anisotropy.

As an example of beneficial usage, if the reinforcement is aligned nanostructures in steel cable, the electrical conductance is increased, the electrical loss is reduced to near zero, and the stiffness is significantly increased, the upper bound of which has not yet been determined. As another example, if structural-grade steel is reinforced with nanostructures, the steel structure strengthens significantly, perhaps thousands of times normal or more, allowing for much stronger steel beams in building structures.

Another embodiment of the invention for incorporating nanostructures into a base material is the use of a batch or continuous casting/fabrication process wherein the particles are injected, mixed, stirred, deposited, or otherwise incorporated onto or into a liquid or semi-solid stream. The blend, dispersion, or mix is then injected into the mold for part formation. In the case of coating, the materials are deposited onto a selective substrate material. This mixture may undergo subsequent thermomechanical or field (magnetic/electric) processing that would provide tailored enhancement of the desired properties in the final solidified reinforced material.

Another embodiment of the invention is the physical mixing of the nanostructures within an aggregate material so that the nanostructures interact with the aggregate mixture so that sufficient heat is generated to enable the process of reinforcement to occur. Such heat may be generated during a chemical reaction (such as carbon going into solution), adhesion/bonding, or cohesive entrainment (such as in the polymerization process or hydration of a cement in a concrete aggregate mixture).

Another embodiment of the invention for incorporating nanostructures into a matrix base material is by the use of a carbon source (such as amorphous carbon), metal catalysts (such as nanosized metals or metal alloys, nickel, nickel-cobalt, etc.), and the matrix material (metallic/ceramic such as metal alloys, ceramics, cermets, or intermetallics alloy) and forming the nanostructures in-situ during the heating process of the composition to form the nanostructure reinforced composite. There are many sources for a carbon source which will provide a carbon feed material that is converted to nanostructured carbon materials used as the reinforcement material in the composite structure. The source of carbon can be, for example, glassy carbon or graphite, but preferably it is amorphous carbon. One example of an application to form a nanostructured reinforced composite material would be as described in the following.

1. Mix the amorphous carbon feed source material, nanosized metal catalysts, and a surfactant such as sodium lauryl sulfate, with the matrix material such as steel, 2. Hot press the mixture into a desired green shape part and then sinter, or 3. Hot press the mixture to a full dense composite part with a desired shape.

The amorphous carbon feed materials can be carbon black, the metal catalysts can be either physical vapor deposited metal nanoparticles, vendor supplied nanometal particles, or nanosized metal particles precipitate from solutions (such as cobalt chloride or nickel chloride solutions with surfactant), and the surfactant can be sodium lauryl sulfate, and the matrix can be a metal alloy such as steel.

The preceding method of forming the nanostructures in-situ during the heating process clearly results in a nanostructured reinforced composite material. However, this method may result in a nanostructured reinforced composite material wherein the density or concentration of nanostructures in the composite could be less, and the material properties not as enhanced, as with the previously described methods where the nanostructure reinforcements are introduced as already formed nanostructured feed or raw materials. On the other hand, this method may be less costly to perform.

Amorphous carbon is the name used for carbon that does not have any clear shape, form, or crystalline structure. It is actually made up of extremely small bits of graphite with varying amounts of other elements, which are considered impurities. This means that amorphous carbon is not a separate allotrope of carbon because the carbon it contains is in graphite form.

Coal and soot are both examples of amorphous carbon. Amorphous carbon is formed when a material containing carbon is burned without enough oxygen for it to burn completely. This black soot, also known as lampblack, gas black, channel black or carbon black, is used to make inks, paints, and rubber products. It can also be pressed into shapes and is used to form the cores of most dry cell batteries, among other things.

FIG. 6 illustrates an embodiment of the invention wherein spray deposition processing (separately or in combination with resistance, induction, infrared, or plasma heating) may be employed wherein composite layers, or surface or alternating layers of nanostructures and matrix material are formed into a useable form. This produces nanostructure reinforced coatings or surfacing on the base bulk material. As an example, the nanostructured material, such as carbon nanotubes, are pre-blended, pre-dispersed, and/or pre-mixed into a matrix material formed into a slurry, spray deposited (using a simple paint spray gun or a plasma spray gun) onto a substrate material, and then post-heat treated or surface heated to densify (sinter) and diffusion-bond to the substrate. The process to heat the surface, as an example, could be by using resistance, induction, infrared, or plasma heating to a selected temperature. Scanning across the surface with a laser, infrared, or welding torch are examples of heating the surface. The temperature to which the surface is heated depends upon the matrix material-nanostructure material relationship and the matrix material-substrate material relationship. As an example, if the matrix material is iron-based or steel, the surface could be heated to a temperature of 1132 degrees Celsius (eutectic point) if performed at a slow scanning rate or 1565 degrees Celsius (melting point) if performed rapidly.

Further, a slurry can simply be made by mixing the raw materials (such as selected metal alloy and the carbon nanotubes) in a liquid (such as ethanol, water, etc.) and effectively dispersing the mixture with a surfactant such as Cetyl Trimethyl Ammonium Bromide (CTAB) or Sodium Dodecyl Sulfate (SDS), also known as Sodium Lauryl Sulfate (SLS).

Final performance of the reinforced material of the invention will be determined by the composite behavior of the nanostructure reinforcement and the base material. This is contingent on volume fraction, processing path, morphology, and any preferred orientation of the reinforcing nanostructures.

Using pressure to condense the materials into a composite structure may also be used. Whether high pressure is applied in a pressing operation or as a high velocity impact bringing particles together, the composite structure can be produced in such a manner. As long as the high pressure causes localized heating, the success of the process becomes more probable.

Figure 7:
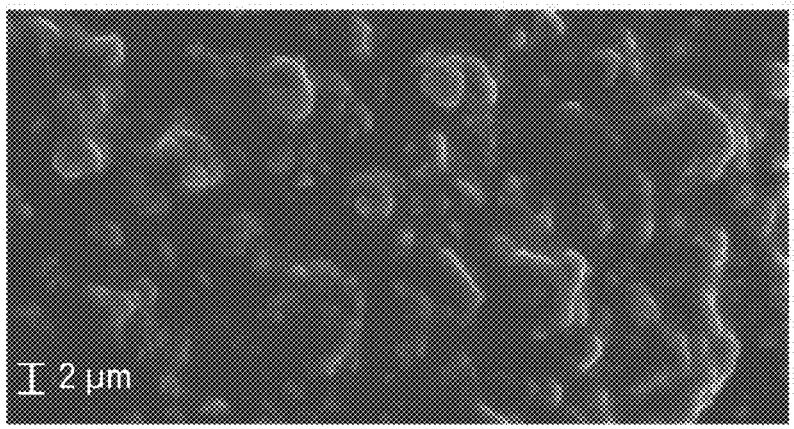
FIG. 7 illustrates bundles of single wall carbon nanotubes dispersed in a metal alloy matrix according to the invention.

FIG. 7 illustrates bundles of single wall carbon nanotubes dispersed in a metal alloy matrix according to the invention.

Figure 8:
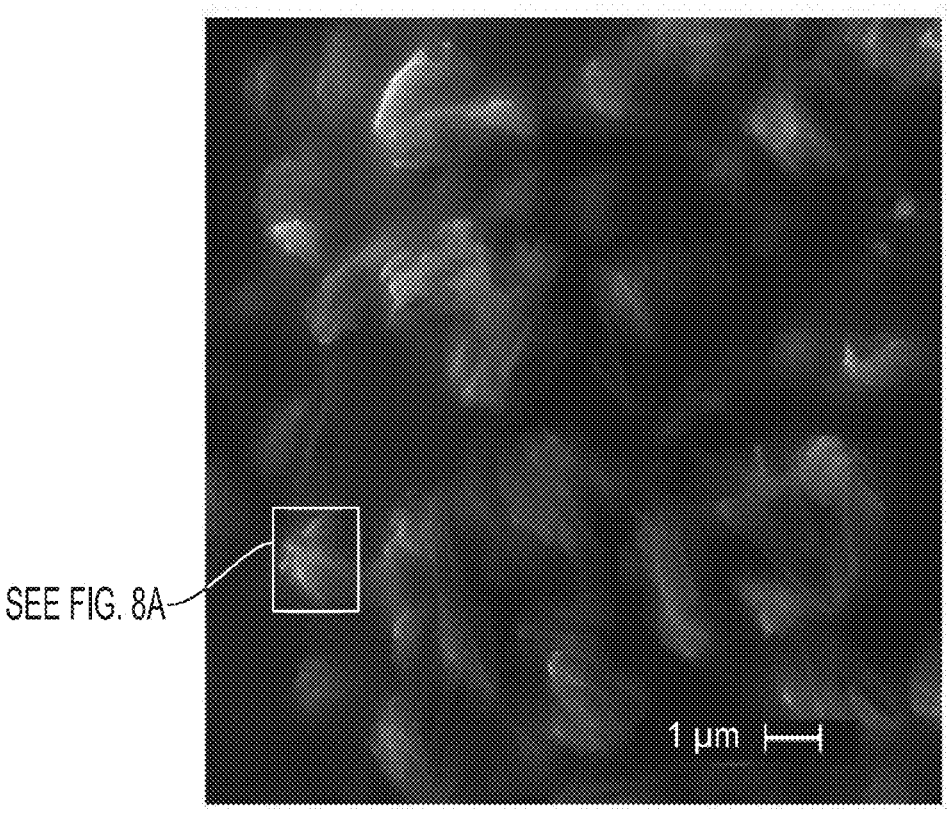
FIG. 8 illustrates bundles of single wall carbon nanotubes wetted by a metal alloy matrix according to the invention.
Figure 8A:
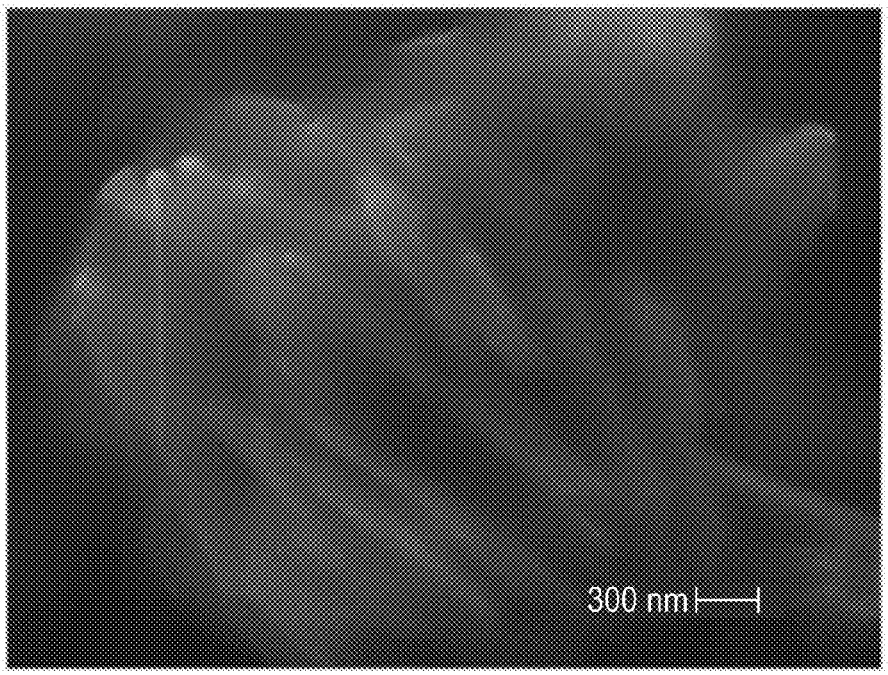
FIG. 8A is an enlarged view of the area indicated by numeral BA in FIG. 8 according to the invention.

FIGS. 8 and 8A illustrate bundles of single wall carbon nanotubes wetted by a metal alloy matrix according to the invention.

Figure 9:
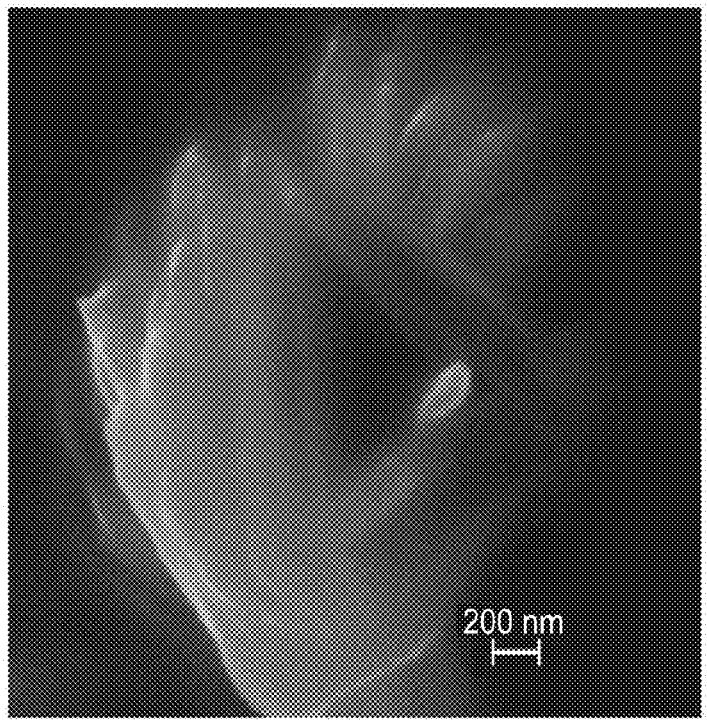
FIG. 9 illustrates single wall carbon nanotubes wetted by a metal in the metal-CNT composite according to the invention.

FIG. 9 illustrates single wall carbon nanotubes wetted by a metal in the metal-CNT composite according to the invention.

Figure 10:
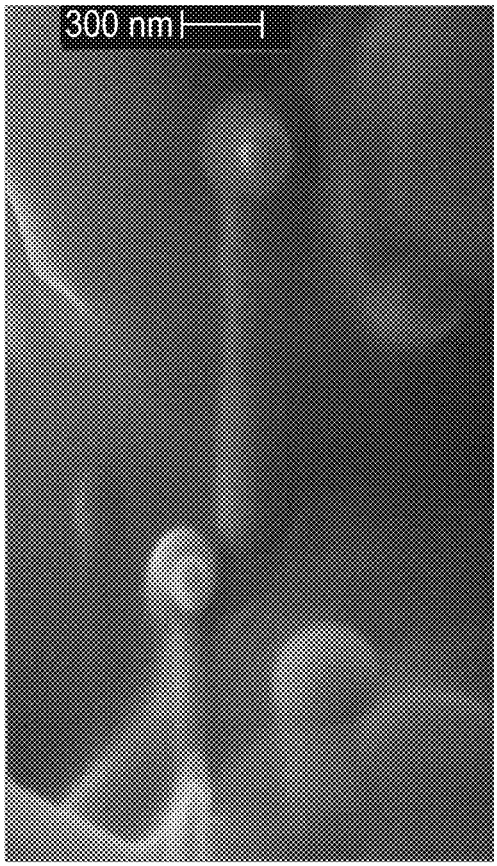
FIG. 10 illustrates single wall carbon nanotubes wetted by metal in a metal-matrix composite according to the invention.

FIG. 10 illustrates single wall carbon nanotubes wetted by metal in a metal-matrix composite (MMC) according to the invention.

The inventors are not aware of prior work with nanostructures to reinforce material as described herein.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed is:

1. A process for producing a reinforced material, comprising the steps:

a. providing a base material;

b. mixing a carbon source material having surface amorphous carbon particles with the base material to form a mixture;

c. depositing said mixture on a surface of a substrate material;

d. sintering said surface of the substrate material and said mixture to form a reinforced coating on the substrate material wherein carbon diffuses into the substrate from the surface amorphous carbon particles on the carbon source material; and e. cooling the coating on the substrate material.

2. The process of claim 1 further comprising applying an electrical or magnetic field to the mixture for aligning the carbon source material along, across, or within grains of the reinforced material.

3. The process of claim 1 wherein the sintering step includes surface heating the surface of the substrate using localized surface heating means.

4. A process for producing a reinforced material, comprising the steps:

a. providing a base material;

b. mixing nanostructures with the base material to form a mixture;

c. depositing said mixture on a surface of a substrate material;

d. applying an electrical or magnetic field to the mixture for aligning the nanostructures along, across, or within grains of the reinforced material;

e. sintering said surface of the substrate material and said mixture to form a reinforced coating on the substrate material; and f. cooling the coating on the substrate material.

5. The process of claim 4 wherein the sintering step includes surface heating the surface of the substrate using localized surface heating means.

6. A process for producing a reinforced material, comprising the steps:

a. providing a base material;

b. mixing nanostructures with the base material to form a mixture;

c. depositing said mixture on a surface of a substrate material;

d. sintering said surface of the substrate material and said mixture to form a reinforced coating on the substrate material, the sintering step including surface heating the surface of the substrate using localized surface heating means; and f. cooling the coating on the substrate material.

* * * * *